US006578742B1

(12) United States Patent
Schuckmann

(10) Patent No.: US 6,578,742 B1
(45) Date of Patent: Jun. 17, 2003

(54) PUMP WHICH CAN BE ACTUATED BY MEANS OF A HAND LEVER FOR SPRAYING LIQUIDS

(76) Inventor: Alfred Schuckmann, Winnekendonker Strasse 52, D-47627 Kevelaer (DE)

( * ) Notice: Subject to any disclaimer, the term of this patent is extended or adjusted under 35 U.S.C. 154(b) by 0 days.

(21) Appl. No.: 09/937,229

(22) PCT Filed: Mar. 24, 2000

(86) PCT No.: PCT/EP00/02630

§ 371 (c)(1),
(2), (4) Date: Mar. 4, 2002

(87) PCT Pub. No.: WO00/58020

PCT Pub. Date: Oct. 5, 2000

(30) Foreign Application Priority Data

Mar. 25, 1999 (DE) ..... 199 13 668

(51) Int. Cl.[7] ..... B67D 5/40
(52) U.S. Cl. ..... 222/383.1
(58) Field of Search ..... 222/383.1

(56) References Cited

U.S. PATENT DOCUMENTS 2,109,589 A 3/1938 Horwitt
2,626,185 A 1/1953 Roselund
5,716,008 A 2/1998 Nottingham
6,364,174 B1 * 4/2002 Lohrman et al. ..... 222/383.1

FOREIGN PATENT DOCUMENTS

JP 52018214 2/1977

* cited by examiner

*Primary Examiner*—Philippe Derakshani
(74) *Attorney, Agent, or Firm*—Martin A. Farber

(57) ABSTRACT

A hand-lever-actuatable pump for spraying liquids comprising a pump piston which is displacable linearly counter to force of a compression spring in a pump cylinder in a housing, for spraying a liquid out of a mouthpiece nozzle, the pump piston being coupled to a hand-lever via a connecting pull member such that pivoting movement of the hand-lever pulls the pump piston in direction of liquid moving toward the mouthpiece nozzle. Starting from a rear side of the pump piston, the connecting pull member extends parallel to the pump piston displacement path in direction of the mouthpiece nozzle. On the rear side of the pump piston there is a hook-in slot which is located in direction of the pump piston displacement path, is open in direction of compressive force of a compression spring and is for a drive crosspiece of the connecting member.

7 Claims, 4 Drawing Sheets

Figure 1:
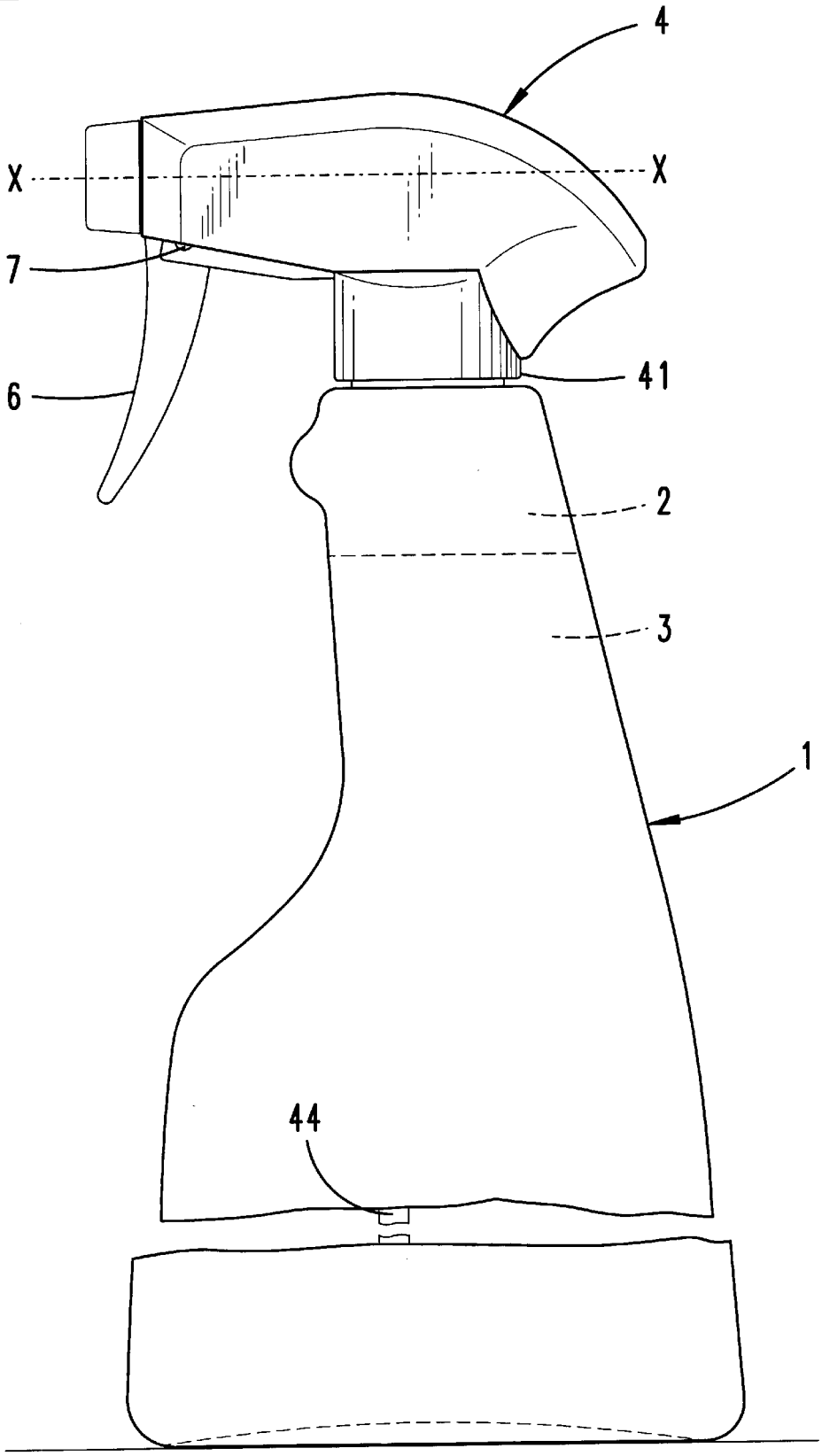

10
15
30
31
32
33
34
35
36
37
38
G
a
b
6
7
8
12
13
14
43
46
47

PUMP WHICH CAN BE ACTUATED BY MEANS OF A HAND LEVER FOR SPRAYING LIQUIDS

FIELD AND BACKGROUND OF THE INVENTION

The invention relates to a hand-lever-actuable pump for spraying liquids, in particular for mounting on bottles or the like, having a pump piston which can be displaced linearly in a pump chamber in the housing and is intended for spraying the liquid out of a mouthpiece nozzle, the pump piston being coupled to the hand lever via a connecting member such that the pivoting movement of the hand lever pulls the piston in the direction of the liquid moving toward the mouthpiece nozzle.

A spray pump of this type is known from U.S. Pat. No. 2,626,185. In the case of this forerunner, the pump piston, including the pump cylinder thereof is located in the bottle. Secured on the bottle neck, the pump housing continues in a pistol-like manner with a trigger-like hand lever mounted in the vertex of the handle and "barrel". The handle lever is double-armed and, by way of the handle-side arm, acts in an articulated manner on a connecting member which, for its part, is seated in an articulated manner on the piston body. The pump piston is pulled counter to a compression spring which is mounted on the piston body and has its abutment in the housing.

U.S. Pat. No. 2,109,589 proposes allowing the double-armed hand lever to act on the pump cylinder and displacing the latter in a linearly guided manner relative to the fixed pump piston. This requires a line section which extends from the vertical tube and moves along with the movements of the pump cylinder. The articulation location between the pump cylinder and said arm provides a slot into which pins of the pump cylinder project. The hand lever itself is mounted pivotably such that it cannot be displaced.

SUMMARY OF THE INVENTION

It is an object of the invention to form a hand-lever-actuable pump of the generic type such that it is structurally straightforward and is reliable to use.

This object is achieved in that, starting from the rear side of the pump piston, the connecting pull member extends parallel to the pump-piston displacement path in the direction of the mouthpiece nozzle. This results in a substantially simplified construction. The connecting pull member and pump piston move in the same direction, i.e. both move linearly. The pump-piston body no longer requires any particular measures in order to carry along the pump piston. Rather, the pump piston is simply subjected to pulling action, and displaced, from the rear side. A straightforward reliable carry-along connection is achieved here in that the rear side has a hook-in slot which is located in the direction of the pump-piston displacement path and is intended for a cross-sectionally non-round drive member of the connecting pull member. As a result, the linear movement or guidance of the pump piston is converted into linear guidance of the connecting pull member. In order, in the case of a pivotable hand-lever version, for the arcuate path of the hand lever and the linear movement of the connecting pull member to be brought into line without constraint in terms of movement, a further configuration is characterized by a slot/pin mounting of the hand lever underneath the liquid-feed channel leading from the pump cylinder to the mouthpiece nozzle. An embodiment of the connecting pull member which is particularly stable during use is achieved if the connecting pull member is configured as an elongate, linearly guided eyelet which encloses the pump cylinder. The eyelet retains the pump piston in a tilt-free manner; it is preferably disposed along the diameter of the cross-section of the pump piston. Furthermore, a structurally advantageous configuration is achieved by a vertical tube which extends upward from the bottle interior and has a liquid-feed channel connecting with it, which channel opens out into the pump chamber in the region of an end wall which is fitted with valves, is directed toward the mouthpiece nozzle and belongs to the pump chamber. This makes it possible to maintain flow paths which run in opposite directions, but shorten the pump. Also advantageous in this context is the measure where the section of the liquid-feed channel which extends coaxially and in extension of the pump chamber is configured as a tubular, resiliently mounted insert element. It is also provided that provided for the resilient mounting of the insert element is a compression spring, the other end of which is supported on the pump-chamber end surface of the pump piston. Such a compression spring, at the same time, forms the restoring spring for the hand lever. It is then proposed that the end surface of the pump piston has a depression into which an end of the insert element which projects freely into the pump chamber can enter. The charge which is to be discharged is delivered by this tubular end in the direction of the mouthpiece nozzle, passing through the annular space-forming surroundings of the insert-element section which has no casing there. A configuration of even independent importance resides in the fact that the valves are fitted on the insert element, to be precise such that an inlet valve and an outlet valve are formed as flexible portions which are integrally formed on the insert element by combination injection molding. The basic body of the insert element itself is of relatively hard configuration, the flexible portions being rubber-like. Such a measure reduces the number of parts and simplifies the assembly. Finally, a further measure is taken, this being embodied in that, when the hand lever is actuated, the pump piston, configured as a double-sleeve piston, passes, by way of the two sleeves, over an air-admission opening, extending to the bottle interior, such that the air-admission opening comes into connection with an air-admission channel which, in the direction of that end of the pump housing which is located opposite the mouthpiece nozzle, extends into the open. In the closed position, the air-admission opening is located, in the cross-sectional plane of the annular space, between the two sleeves. This avoids, by straightforward means, loss of medium, for example if the spray dispenser, which is designed to stand up, falls over and/or is transported in a horizontal position.

Figure 2:
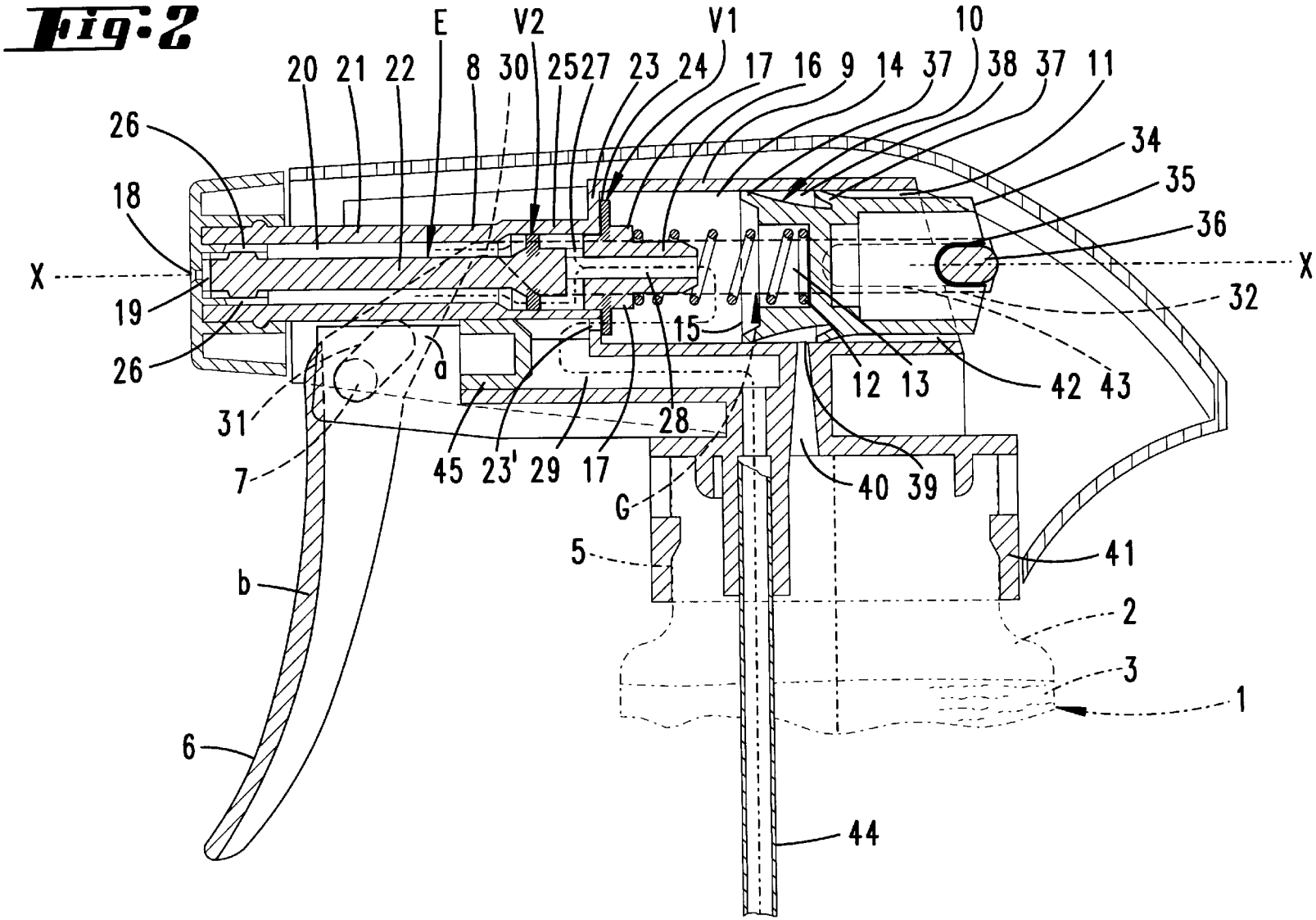
Figure 3:
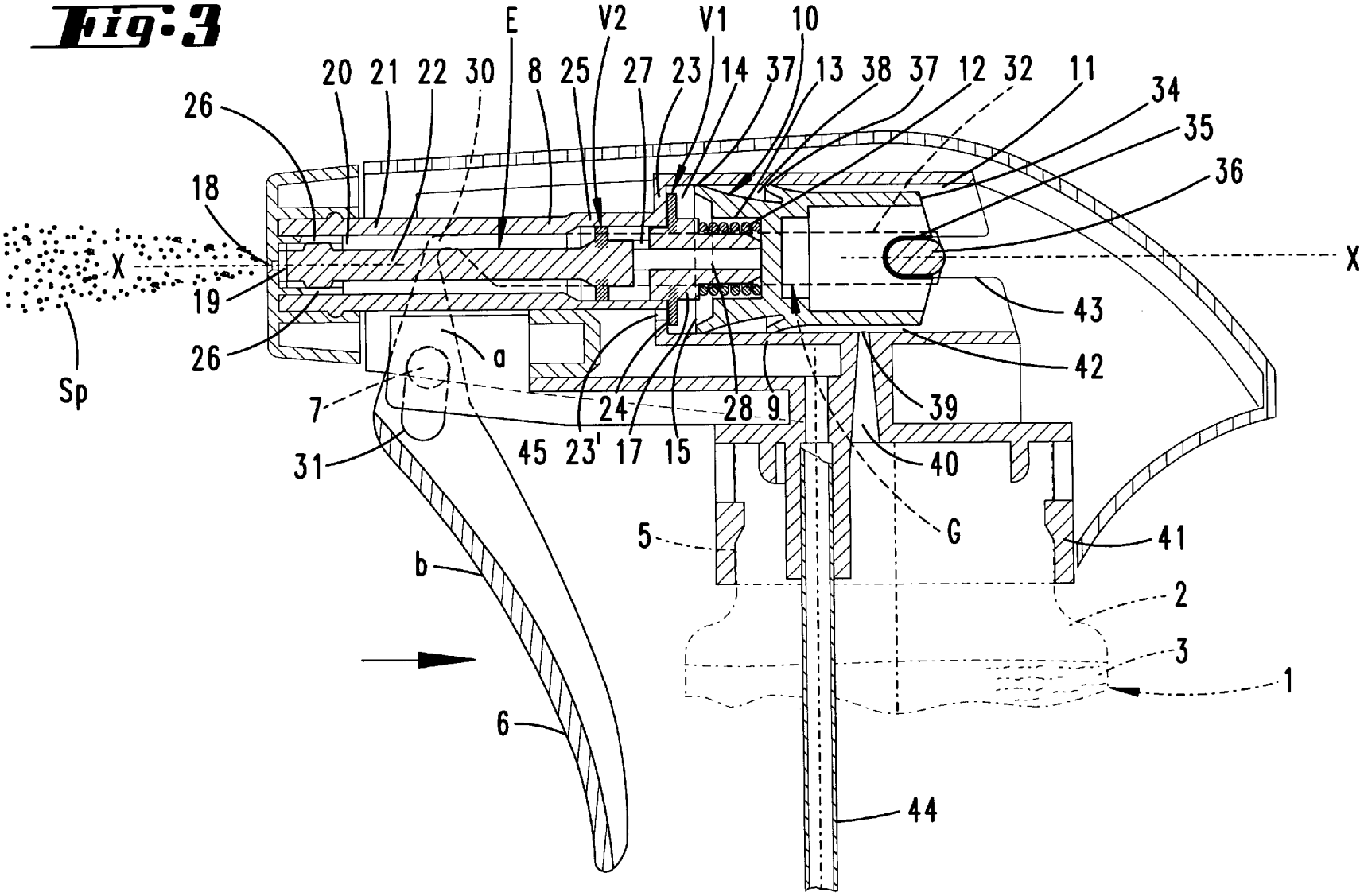
Figures 4, 5:
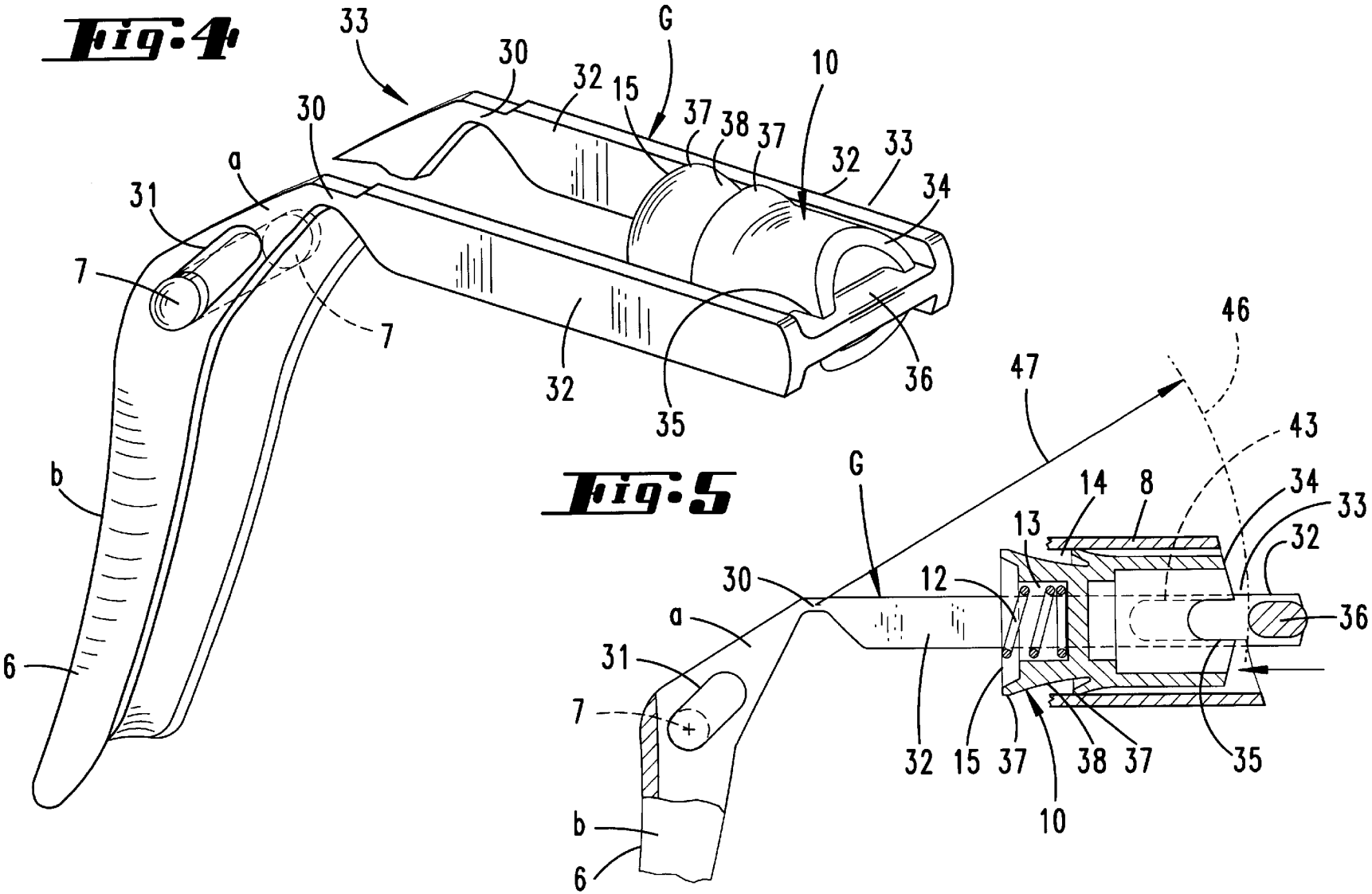

The subject matter of the invention is explained in more detail hereinbelow with reference to an exemplary embodiment illustrated in the drawing, in which:

FIG. 1 shows a side view of the bottle with the spray pump mounted, to be precise in the basic position, FIG. 2 shows a vertical section through the spray pump with the bottle neck indicated, likewise in the basic position, FIG. 3 shows the spray pump in the illustration as in FIG. 2, but in a state in which its hand lever is actuated, FIG. 4 shows, in perspective view, the hand lever/connecting pull member unit with pump-piston hook-in means, FIG. 5 shows the abovementioned unit in a position in which it is ready for assembly, to be precise prior to hook-in.

The illustration shows a bottle 1 in the standing position. The bottle interior 2 contains sprayable liquid 3. A pump 4 is used for spraying purposes. The pump is mounted on the neck 5 of the bottle 1. This may be realized by screw-connection means, or else by click-on connection or using a bayonet closure. For refilling the bottle 1 with liquid 3, a reversible association of the pump 6, a so-called trigger pump, is preferably provided.

The actuating element of the pump 4 is a hand lever 6. This is double-armed and is mounted such that it can be pivoted about a horizontally oriented pin 7. This may be embodied by journals which are provided in pairs, originate in a housing 8 of the pump 4 and project freely into spaces in the same. The latter help to guide the hand lever 6 pivotably.

The pump housing 8 consists of plastics. It allows for the incorporation of a piston/cylinder unit. The pump cylinder of the latter is designated 9. It accommodates a double-cup-like pump piston 10. The latter is inserted into the pump cylinder 9 from the end 11 of the pump cylinder 9, said end being open on the right, and is subjected to spring loading in the outward direction. The spring is a compression spring 12. The cups of the pump piston 10 open in opposite directions. They have a common transverse base.

The compression spring 12 has one end, in the vicinity of the piston, positioned in one of the cups, more precisely in a cup-forming depression 13 of the pump piston 10. Engagement thus takes place in an axially overlapping manner over the end surface 15 of the pump piston 10, this end surface being directed toward a pump chamber 14, in that, with pump actuation, an end 16 of an insert element E, this end projecting in the direction of the central depression 13, can penetrate into the latter in a stop-limited manner. The pump piston 10 runs up, overlapping the end 16. This end 16 accommodates the other end of the compression spring 12 in a stop-forming and position-arresting manner. An annular collar 17 is used for this purpose.

The insert element E, which is subjected to loading by the compression spring 12 and forms an abutment for the same, extends to in front of a mouthpiece nozzle 18 of the pump 4. The end of the insert element there forms a vortex chamber 19. The liquid 3 which is to be sprayed runs toward this vortex chamber 19 via an annular channel 20. The latter is realized between a tubular section 21 of the housing 8 and a solid spindle 22 of the insert element E.

The annular-channel-forming tubular section 21 has a smaller clear diameter or cross-section than the pump chamber 14 positioned upstream of it. The corresponding offset wall formation results in an end wall designated 23. The annular flank of the latter, directed toward the pump chamber 14, forms a valve-seat surface 24. An inlet valve V1 interacts with the latter. The inlet valve extends just behind the annular collar 17, which forms the abutment for the compression spring 12, and is retained in closed abutment in relation to 24 by this compression spring 12. The insert element is thus resiliently mounted with a stop in the direction of its plug-in position.

An outlet valve V2 is spaced apart axially from the inlet valve V1, which is in the form of an annular disk. The outlet valve, which is closer to the mouthpiece nozzle 18 than the inlet valve V1, adjoins the latter and is likewise configured in the form of an annular disk. It is seated in an intermediate tubular section 25 of the pump housing 8, the intermediate tubular section having a somewhat larger diameter than 21. Here too, it is the clear diameter which is meant.

That end region of the spindle 22 which is directed toward the vortex chamber 19 has ribs on the inside of the tube, the ribs leaving peripheral longitudinal channels 26 between them, so that the liquid 3 passes into the vortex chamber 19.

A radial outlet end 27 of a section 28 of a liquid channel 29, this section extending into the pump chamber 14, opens out between the inlet valve V1 and the outlet valve V2. The insert element E is accordingly of tubular configuration in this region. Via the radial outlet ends 27, which are preferably arranged diametrically in pairs, the liquid 3 moving, under pump actuation, in the direction of the mouthpiece nozzle 18 passes into the annular channel 20 via the outlet valve V2. The end surface of the outlet valve V2, which here too is in the form of an annular disk, has, as valve-seat surface, the inner wall of the annular channel 22, which is configured with a larger cross-section there, that is to say that of the intermediate tubular section 25.

The inlet valve V1 and the outlet valve V2 are integral annular collars of the insert element E. These annular-collar-like portions are integrally formed on the insert element E by combination injection molding. They consist of more flexible material, and provide a valve-flap-like capacity for movement in relation to the considerably harder material of the core element, that is to say of the insert element E.

Hand-lever-actuated displacement of the pump piston 10 in the pump cylinder 9, which has a guiding action in this respect, takes place linearly. The respective line, which is identical to the direction of the pump-piston displacement path, is designated x—x in the drawing. It extends essentially horizontally with the bottle 1 located in the standing position, which substantially also corresponds to the use situation, in which the user grips the handle-forming section of the bottle 1 in the vicinity of the neck.

For displacing the pump piston 10 in order to discharge the liquid 3, the double-armed hand lever 6 acts indirectly on the displaceable pump piston 10 by way of a first arm a directed into the housing. The second arm, designated b, functions as a trigger. The length ratio of the arms a, b, which are located at an obtuse angle in relation to one another, is approximately 1:3. Projecting vertically from the angle vertex, the arm b is directed away from the bottle 1 with a slight forward curvature at the end. The arm a is oriented with a slight slope, especially running at an angle of 90° in relation to the vertical.

A connecting member G constitutes movement-transmission means. It extends parallel to the line x—x and runs in a horizontal diametral plane in relation to the pump piston 10, having a circular cross-section, and also in relation to the insert element E, which is disposed in front of the same and is likewise of rotationally symmetrical configuration.

That end of the connection member G which is directed toward the mouthpiece nozzle 18 acts on the free end of the arm a of the hand lever 6 via an articulation location 30. It is also the case that this articulation location 30 is displaced, under hand-lever actuation, in a strictly linearly manner despite the pivoting movement of the arm a which takes place at the same time. These coinciding movements taking place linearly in relation to the circle arc are compensated for in the region of the pin 7, i.e., rather than executing merely a pivoting movement about 7, the hand lever 6, at the same time, also executes a yielding movement in the downward direction and in the direction of the bottle 1. This is achieved in structural terms by a slot/pin mounting of the hand lever 6 spatially some way underneath the liquid-feed channel 29 leading from the pump cylinder 9 to the mouthpiece nozzle 18. You are referred to the actuating position in FIG. 3. More precisely, the slot/pin mounting is located underneath the annular channel 20, which forms a continuation of the liquid channel 29. The slot which runs in the direction of the articulation-location end is designated 31. Lengthwise, it allows for the pivoting angle and displacement range of the hand lever 6. Both ends of the slot 31 can be utilized in a stop-forming manner, in interaction with the stationary, cross-sectionally circular pin 7.

The connecting member G is designed with a pair of pulling tongues 32, although one would also be sufficient. In concrete terms, the connecting pull member G is realized as an elongate, linearly guided eyelet 33 which encloses the pump cylinder 9 at a spacing from the outer wall thereof. This eyelet 33 runs in a stirrup-like manner on the right, the end portion which is directed toward the mouthpiece nozzle 18 running into the articulation point 30 which is formed by a cross-sectional reduction in the material and forms a film hinge. This then causes the eyelet to be formed in one piece with the fork-like arm a of the hand lever 6. This is U-profiled from the angle vertex or pin 7. The U-opening is oriented in the direction of the bottle.

The illustrations of the drawing clearly show that, starting from the rear side 34 of the pump piston 10, the connecting pull member G extends parallel to the pump-piston displacement path in the direction of the mouthpiece nozzle 18.

Although measures could be taken in the housing in order to ensure the displacement direction in this respect, it has been found to be sufficient to have a solution in which the rear side 34 has a hook-in slot 35 located in the direction of the pump-piston displacement path. Positioned in a snaffle-like manner, a drive member 36 formed by the U-bend of the stirrup-like component engages in the hook-in slot. As can be seen, the drive member is not round. It has an oval cross-section with parallel flattened portions which are supported in a rotationally fixed manner on the corresponding parallel flank of the hook-in slot 35. The linear movement of the pump piston 10 is thus converted into a correspondingly space-parallel linear displacement of the pulling tongues 32.

The hand-lever-actuable pump 4 has a double-sleeve piston as pump piston 10. Its axially spaced-apart sleeves 37, which terminate in annular lips, leave an annular space 38 between them. In the basic position of the pump 4, the annular space is connected to an air-admission opening 39 of the pump housing 8. When the pump 4 is actuated, the sleeves pass over the air-admission opening in a slide-like manner. The air-admission opening 39 is connected to the bottle interior 2 via a vertically oriented intermediate channel 40. Said intermediate channel 40 also passes through the top of a connection stub 41 of the pump 4, which serves for mounting the same on the neck 5 of the bottle 1. This achieves effective air equalization, which only takes place in the phase of actuating the pump 4, but, in the basic position of the latter, keeps the bottle interior 2 closed in relation to the atmosphere.

When actuated, the pump piston 10, which acts in the manner of a valve slide, passes out of the region of the air-admission opening 39 such that the latter is then connected to an air-admission channel 42 which, in the direction of that end of the pump housing 8 which is located opposite the mouthpiece nozzle 18, extends into the open.

Handling takes place as follows: when the hand lever 6 is actuated by pulling, the pump piston 10 is displaced to the mouthpiece-nozzle end via the connecting pull member G, counter to the force of the compression spring 12. This results in a reduction in the volume of the pump chamber 14 (see FIG. 3). The quantity located therein from a prior actuation, passing via the section 28 of the liquid-feed channel 29 and the annular channel 20, is discharged as a powerful spray jet Sp via the mouthpiece opening 18. In order to allow the drive member 36 the necessary penetrating movement in the housing, from the end border there of that end of the housing 8 which is open on the right, a slot-like guide niche 43, which extends from there and is located along the line x—x, is realized, to be precise, as in the case of 35, likewise in the form of a pair congruently one beneath the other. This likewise assists the linear movement of the connecting pull member G. The outlet valve V2 opens under corresponding discharge pressure. Once the divided-off charge has been discharged, the hand lever 6 is released and passes into its basic position according to FIG. 2 again. In this case, the compression spring 12 functions as a restoring spring for the hand lever 6. With this rearward-displacement force to which the pump piston 10 is subjected via the pushing action of the compression spring 12, negative pressure is produced in the pump chamber 14. The pump chamber fills when the inlet valve V1 is opened, so that approaching medium is brought into the pump chamber 14 via a vertical tube 44. The valve-seat surface 24, which is covered by valve flaps, is provided, for this purpose, with a through-passage 23' in the annular wall 23. It is also possible for a number of these to be distributed at equal angles. The resiliently mounted insert element E can be displaced to the right, moving slightly counter to the spring force, with valve-opening action. The pump chamber 14 is thus filled more quickly. With piston pressure, the basic position of the insert element E is immediately resumed, i.e. V1 is closed.

The operation of pulling the hand lever 6 back into its starting position is performed by the pump piston 10, which extends in a spring-loaded manner and pulls the arm a to the right via the drive member 36 and the attached pulling tongues 32. In this case, the slot 31 is also displaced into the upper position in relation to the pin 7.

The housing 8 is advantageously configured by injection molding insofar as the U-shaped section of the liquid-feed channel 29 can be reclosed in the outward direction, just behind the pin 7, by a stopper 45, a bend being formed in the channel as a result.

Assembly takes place as follows: once the insert element E has been introduced into the housing 8, the compression spring 12 is placed onto the tubular end 16, which forms a corresponding supporting journal. The pump piston 10 is then inserted from the open end 11 of the pump chamber 14. The hand lever/connecting pull member unit 6/G is then fitted. The latter is pivoted via the piston tail, which is pressed in briefly in the manner of a pushbutton counter to the spring action, until the drive member 36 is located along line x—x in relation to the hook-in slot 35. Following release of the pump piston 10, the latter moves outward and is arrested in relation to the stirrup-like connecting pull member G. The pump 4 is ready for functioning. The pivoting arc runs around the articulation location 30 and is designated 46. It is sufficiently spaced apart from the rear side 34 since the radius 47 illustrated suffices.

I claim:

1. A hand-lever-actuable pump (4) for spraying liquid, in particular for mounting on bottles (1) and the like, comprising a pump piston (10) which is displacable linearly (line x—x) counter to force of a compression spring (12) in a pump chamber (9) in a housing and is intended for spraying the liquid (3) out of a mouthpiece nozzle (18), the pump piston (10) being coupled to a hand lever (6) via a connecting pull member (G) such that pivoting movement of the hand lever (6) pulls the pump piston (10) in direction of the liquid moving toward the mouthpiece nozzle (18), and furthermore, starting from a rear side (34) of the pump piston (10), the connecting pull member (G) extending parallel to pump-piston displacement path in direction of the mouthpiece nozzle (18), wherein on the rear side (34) of the pump piston (10) is a hook-in slot (35) which is located in direction of the pump-piston displacement path, is open in direction of compressive force of the compression spring (12) and is intended for a drive crosspiece (36) of the connecting pull member (G).

2. The hand-lever-actuable pump as claimed in claim 1, further comprising a slot/pin mmounting (31) of the hand lever (6) underneath a liquid-feed channel (29) leading from the pump cylinder (9) to the mouthpiece nozzle (18).

3. The hand-lever-actuable pump as claimed in claim 1, wherein the drive crosspiece (36) has a non-round cross-section and wherein a larger diameter runs in the direction of the force of the compression spring (12).

4. The hand-lever-actuable pump as claimed in claim 1, wherein the connecting pull member (G) is formed as an elongate, closed eyelet (32) enclosing the pump cylinder (9).

5. The hand-lever-actuable pump as claimed in claim 2, wherein a section (28) of the liquid-feed channel (29) which extends coaxially and in extension of pump chamber (14) is a tubular insert element (E) which is subjected to loading by the compression spring (12).

6. The hand-lever-actuable pump as claimed in claim 5, wherein an end surface (15) of the pump piston (10) has a depression (13) into which an end (16) of the insert element (E), which projects freely into the pump chamber (14), is enterable.

7. The hand-lever-actuable pump as claimed in claim 5, wherein an inlet valve (V1) and an outlet valve (V2) are formed as flexible portions which are integrally formed on the insert element (E) by combination injection molding.

* * * * *

UNITED STATES PATENT AND TRADEMARK OFFICE

CERTIFICATE OF CORRECTION

PATENT NO. : 6,578,742 B2
DATED : June 17, 2003
INVENTOR(S) : Alfred von Schuckmann It is certified that error appears in the above-identified patent and that said Letters Patent is hereby corrected as shown below:

Title page,
Item [76], Inventor, change "Alfred Schuckmann" to -- Alfred von Schuckmann --

Signed and Sealed this

Ninth Day of December, 2003

JAMES E. ROGAN
*Director of the United States Patent and Trademark Office*